US007635061B2

(12) United States Patent
Cuomo

(10) Patent No.: US 7,635,061 B2
(45) Date of Patent: Dec. 22, 2009

(54) CARRIER AND METHOD

(75) Inventor: Angelo V. Cuomo, Staten Island, NY (US)

(73) Assignee: SJV Food & Beverage Carriers, Inc., Clark, NJ (US)

( * ) Notice: Subject to any disclaimer, the term of this patent is extended or adjusted under 35 U.S.C. 154(b) by 267 days.

(21) Appl. No.: 11/712,015

(22) Filed: Feb. 28, 2007

(65) Prior Publication Data

US 2007/0193890 A1 Aug. 23, 2007

Related U.S. Application Data

(62) Division of application No. 10/215,938, filed on Aug. 9, 2002, now Pat. No. 7,185,758.

(51) Int. Cl.
*B65D 75/00* (2006.01)

(52) U.S. Cl. ..... 206/162

(58) Field of Classification Search ..... 206/162, 206/163, 167, 168, 171, 173, 174, 175, 170, 206/180, 198

See application file for complete search history.

(56) References Cited

U.S. PATENT DOCUMENTS

| | | | | |
|---|---|---|---|---|
| 2,011,232 | A | 8/1935 | Parks et al. | |
| 2,513,079 | A | 6/1950 | Buerger | |
| 2,630,264 | A | 4/1953 | Holy | |
| 2,759,629 | A * | 8/1956 | Sargent | 206/199 |
| 2,991,908 | A | 7/1961 | Conescu | |
| 3,158,286 | A | 11/1964 | Phillips, Jr. | |
| 3,576,274 | A | 4/1971 | Stramaglia | |
| 4,007,869 | A | 2/1977 | Stolkin | |
| 4,378,880 | A | 4/1983 | Summers | |
| 4,610,349 | A | 9/1986 | Schwartz et al. | |
| 4,767,051 | A | 8/1988 | Single | |
| 4,770,294 | A | 9/1988 | Graser | |
| 4,836,367 | A | 6/1989 | Golkar | |
| 5,332,091 | A * | 7/1994 | Gugler | 206/167 |
| D367,409 | S | 2/1996 | Hunter | |
| 5,695,051 | A | 12/1997 | Hart | |
| 5,709,298 | A | 1/1998 | Harris | |
| 5,738,217 | A * | 4/1998 | Hunter | 206/549 |
| 5,803,264 | A * | 9/1998 | Gersten et al. | 206/549 |
| 5,884,756 | A * | 3/1999 | Holley et al. | 206/144 |
| 5,927,502 | A * | 7/1999 | Hunter | 206/549 |
| 5,927,593 | A | 7/1999 | Berkowitz et al. | |
| 6,341,689 | B1 | 1/2002 | Jones | |
| 6,443,308 | B1 | 9/2002 | Davis | |

* cited by examiner

*Primary Examiner*—Jacob K Ackun, Jr.
*Assistant Examiner*—King M Chu
(74) *Attorney, Agent, or Firm*—Gregor N. Neff, Esq.

(57) ABSTRACT

The food carrier has a central vertical support panel with a handle and a pair of trays with beverage cup holders attached to the central support panel. A folded side-wall structure can be unfolded to start the formation of the trays, and a folded bottom panel or two-panel structure unfolds into the side-wall outline to stabilize the side-wall and hold the carrier erect while it is resting on a flat surface thus to make unfolding and loading the carrier quicker and easier. An auxiliary tray can be slipped into the central vertical support to hold solid foods, and both beverages and solid foods can be carried. Advantageously, the auxiliary tray can have substantially the same structure as the first carrier unit, except it has no beverage-receiving holes. It can be mounted to ride "piggyback" on the first carrier, or it can be used alone.

13 Claims, 5 Drawing Sheets

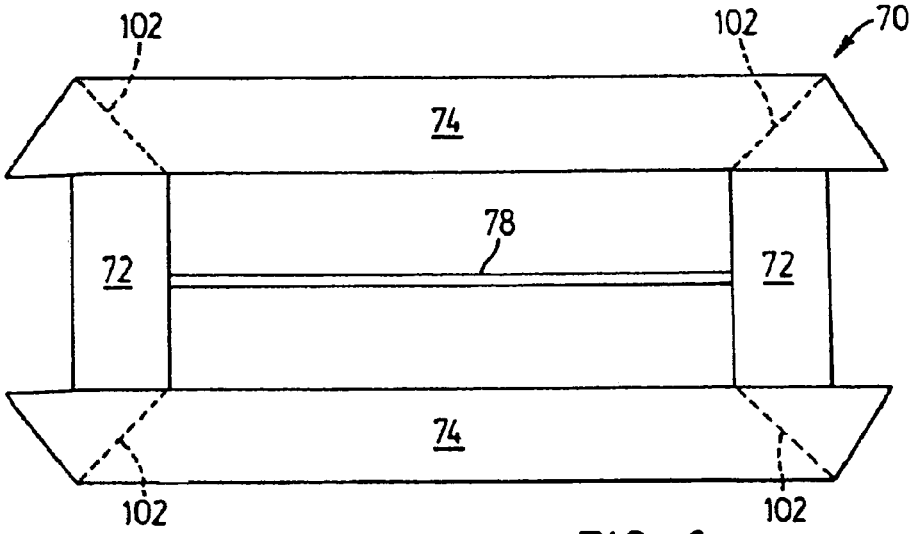
FIG. 6
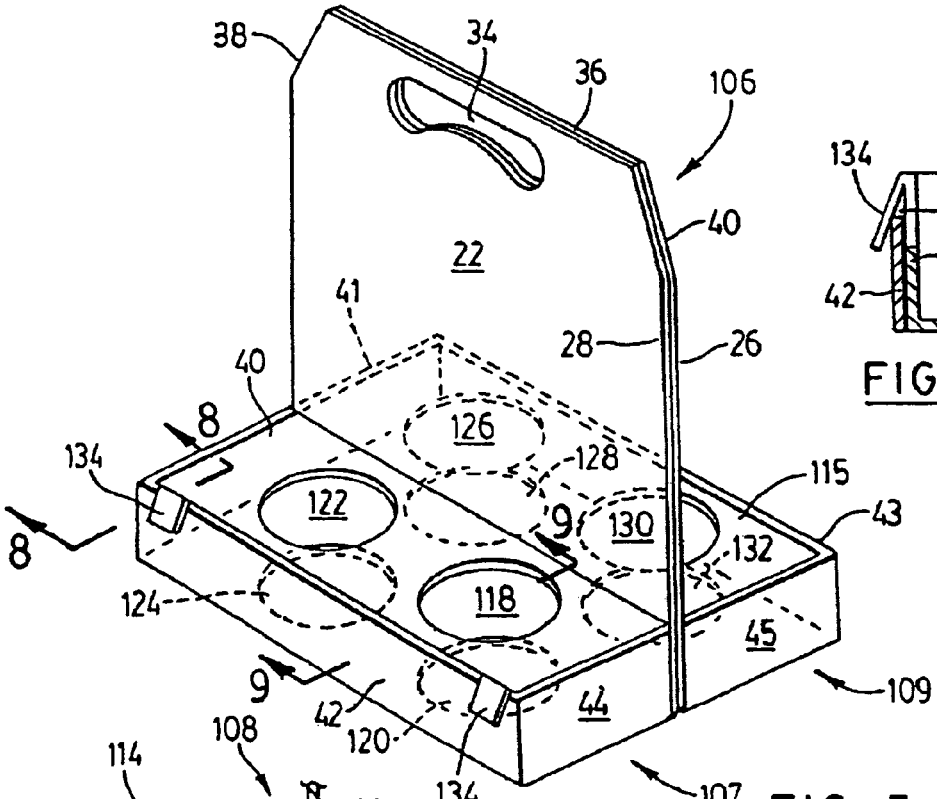
FIG. 7
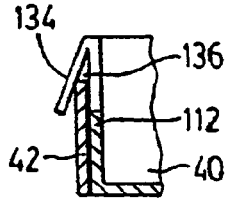
FIG. 8
FIG. 9

CARRIER AND METHOD

This invention relates to food carriers. and distribution methods, and particularly to carriers and methods used in distributing prepared foods, including beverages.

A problem of long standing is that of distributing food from distribution stands, stores, restaurants, etc., to people to carry to a distant site at which the food is to be eaten. It is difficult for one to carry much more than one or two beverage cups, or one cup and one item of solid food, if only the hands are-available for use in carrying the food.

Food carriers are used when more substantial quantities of food must be carried. However, because the carriers must be relatively low in cost, they usually are relatively flimsy and are easily deformed to cause the food to spill from the carrier.

One type of prior carrier has a pair of foldable trays secured to a central support panel with a hand-hold used for carrying the device. The trays have beverage-receiving holes for use in carrying up to four full beverage cups. An auxiliary tray with a long slot in the bottom is fitted onto the central support panel with the panel extending through the slot. The auxiliary tray typically is used for holding solid foods such as hot dogs. The auxiliary tray can rest upon the tops of the beverage containers below it. The carrier thus can be used to carry food and beverages for several people.

The foregoing type of carrier has several disadvantages.

One disadvantage is that several different motions are required in order to unfold the flattened carrier and prepare it for use. This makes the carrier relatively slow and intricate to use.

Another disadvantage is that the container often will not stand up on a horizontal surface by itself. This makes it more difficult and slower to load the food into the carrier.

It has been suggested that such carriers be used to carry advertising for sponsors who supply the. carriers. By doing this the relatively higher costs of the carriers are paid by advertisers. Thus, it is desirable to maximize the surface area available for such advertising without excessive increases in cost.

Accordingly, it is an object of the invention to provide a food carrier and method which eliminate or alleviate the foregoing disadvantages.

In particular, it is an object of the invention to provide a food carrier which is relatively quick and easy to unfold and set up, and thus speeds the food distribution process.

It is another object to provide such a carrier which is relatively sturdy and easy to load and unload, thus further speeding and smoothing the distribution of food.

It is a further object to provide such a carrier with an increased surface area for displaying advertising.

It is an additional object to provide a carrier which is relatively economical to make, and is sturdy and reliable in use.

In accordance with the present invention, the foregoing objects are met by the provision of a food carrier and method having a central support panel with folded trays on opposite sides, each of the trays consisting of a folded side-wall structure which unfolds to provide a side wall, and a folded horizontal support panel which unfolds to. fit into the side wall and hold it. This structure holds the carrier erect when positioned on a flat surface, and greatly facilitates the loading of food into the carrier.

Preferably, the horizontal panel has at least one hole for receiving and holding a beverage cup.

A holding structure preferably is provided to hold the horizontal panel relative to the side wall to support the load to be carried.

In one embodiment, the holding structure comprises a projecting surface extending inwardly from the side wall so as to support the horizontal panel and any food resting on that panel. In another embodiment, the holding structure includes a tab on one of the parts which engages the other part.

Preferably, the horizontal. panel is structured so as to automatically enter the confines of the side wall when the side wall is unfolded so that the carrier is unfolded and set up for use in a single motion.

Preferably, the horizontal panel is located adjacent the bottom edge of the side wall.

In another embodiment of the invention, in each tray there are two vertically spaced-apart horizontal panels connected to one another, each having at least one beverage-receiving hole aligned with a similar hole in the other panel to support and hold a beverage container.

An optional auxiliary tray is provided. It has a slot in the bottom through which the central panel is inserted. This tray can be used to hold solid food items, with the tray resting on either the tops of beverage containers held in the trays, or on the upper edges of the side-walls.

In another embodiment, the auxiliary tray has the same construction as the main carrier except that its trays have no beverage cup holes and it has a central recess which fits over the central support panel of the carrier. This auxiliary tray can be used independently as a solid food carrier.

The carrier is relatively quick and easy to use. The food server prepares the food to the customer's order. Then, he or she merely unfolds the side-wall structure and places the carrier on a flat surface. Then the server loads the carrier with food. Because the carrier stands erect on its own, the server can use both hands to load the food into the carrier.

If the order is only for liquid foods, such as soup or beverages, the beverage containing cups are inserted into the receiving holes in the trays, and the carrier is grasped by the handle and carried away by the customer.

If the order also includes solid foods, such as hot dogs, hamburgers, bags of peanuts, potato chips, popcorn, etc., then the auxiliary tray is slipped downwardly onto the central support panel, the sold food is placed in the auxiliary tray, and the customer grasps the handle and carries all of the good items away with one hand.

If the order includes only solid food items, they can be placed in the carrier trays, as long as they are large enough not to pass through the beverage-receiving holes.

Alternatively, the solid food items can be carried in one of the auxiliary trays described above.

Food distribution using the carriers of the invention is made faster and easier, both for the servers and the customers, in many different types of events and locations. For example, the carrier can be used to advantage in distributing food from concession stands in baseball, football, tennis and other stadiums; in basketball and other indoor sports arenas; at picnics, indoor and outdoor political and other meetings, and conventions; at self-serve or other carry-out restaurants; at parties and other social gatherings, and at virtually any function or location where food must be carried by the consumer.

Advantageously, the carrier bears the Advertisements of one or more sponsors who either supply the carriers for free or defray some of their cost. The advertising can include tear-off coupons good for credit against the purchase of merchandise in order to promote the sale of the merchandise.

Advantageously, the carrier of the present invention has an increased exterior surface area for displaying such advertising.

The foregoing and other objects and advantages of the invention will be apparent from or explained in the following description and drawings.

IN THE DRAWINGS

FIG. 6 is a top plan view of the folded auxiliary tray of the carrier shown in FIG. 1;

FIG. 7 is a perspective view of another embodiment of the carrier of the invention;

FIG. 8 is a cross-sectional, broken away view taken along line 8-8 of FIG. 7;

FIG. 9 is a cross-sectional, broken away view taken along line 9-9 of FIG. 7;

GENERAL DESCRIPTION

Figure 1:
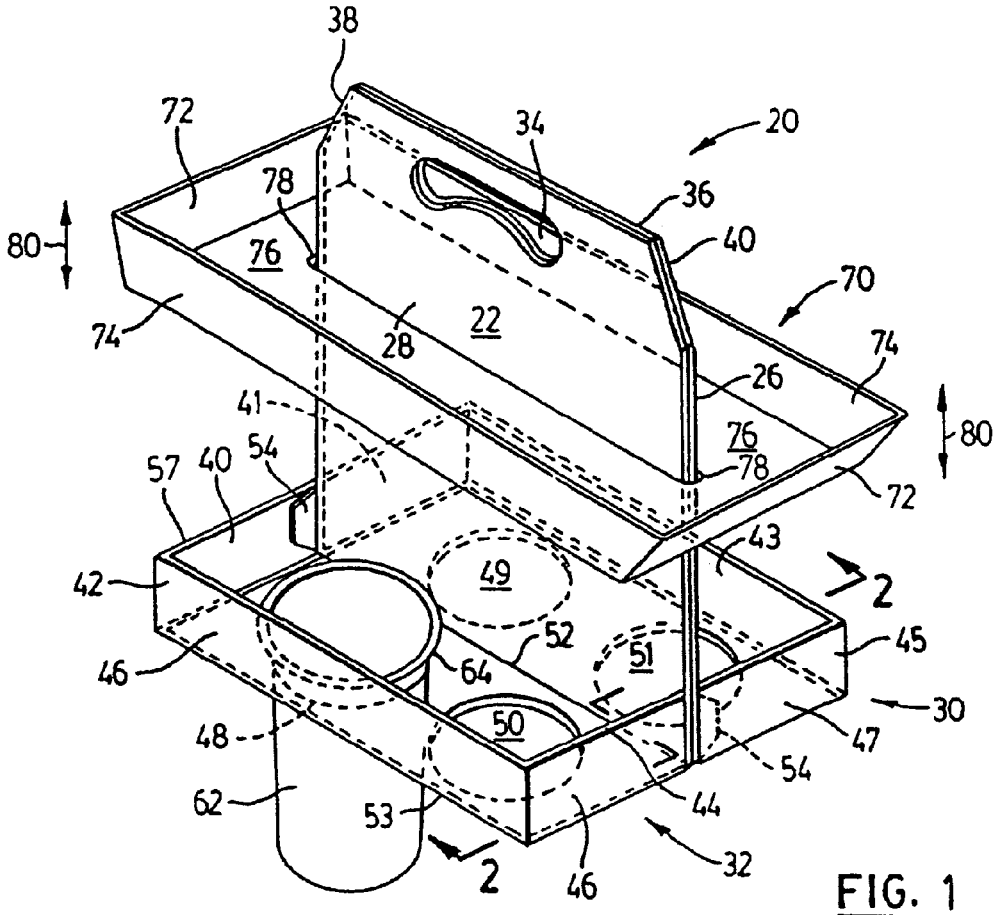
FIG. 1 is a perspective view of one embodiment of the food carrier of the present invention.

Referring first to FIG. 1, the food carrier 20 of the present invention includes a central vertical support panel 22 made of two separate fiberboard panels 26 and 28 adhered together with adhesive to form a laminate.

Extending outwardly from opposite sides of the central panel 22 are two trays 30 and 32 for carrying beverages in up to four cups, such as the cup 62, or solid foods.

Also shown in FIG. 1 is an optional auxiliary tray 70 with side walls 72 and 74 and a bottom wall 76 with an elongated central slot 78.

When the customer orders solid food as. well as several beverages, the auxiliary tray 70 is fitted down over the central support panel 22 which extends through the slot 78, and the auxiliary tray 70 slides downwardly until it rests on top of the beverage cups or the upper edges 52 of the trays 30 and 32. A hand-hole 34 is provided in the central support panel 22 and the entire assembly can be carried from a concession stand to the seats in a stadium or the like by using only one hand inserted through the hand-hole 34.

When the customer returns to his or her seat, the customer removes the solid foods from the tray 70, slips the tray 70 off of the central support panel 22, and then removes the beverages from the trays 30 and 32 to distribute to the people for whom the food was ordered.

Advantageously, both the base of the carrier, consisting of the central support panel 22 and the trays 30 and 32, and the auxiliary tray 70 fold flat for compact storage at the concession stand. As it will be explained in greater detail below, the base unit is particularly advantageous in that it can be unfolded very quickly and easily and stands erect on its own so that it can be loaded with beverages very quickly, thus enhancing the efficiency of the food servers using them.

Also in accordance with the present invention, the carrier has an enlarged surface area for the display of advertising by advertisers who buy and supply the carriers to the food vendors or distributors, thus maximizing the advertising value to the advertisers.

Preferred Carrier Base

The preferred carrier base shown in FIG. 1 has a construction which makes the base relatively easy and quick to unfold, and yet enables it to stand erect on a horizontal surface to greatly speed loading food into it.

Figure 2:
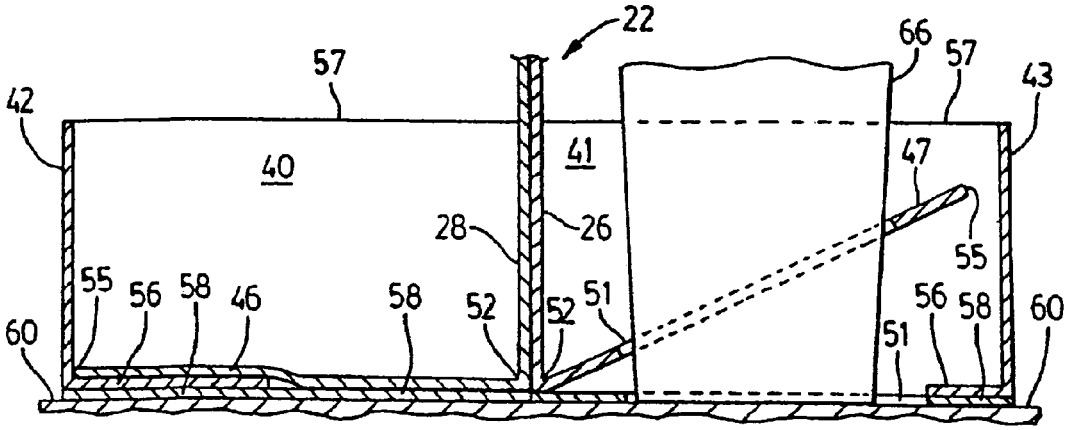
FIG. 2 is a cross-sectional, partially broken-away view taken along line 2-2 of FIG. 1, with modifications to illustrate the operation of the invention.

Referring now to both FIGS. 1 and 2, the tray 32 includes a vertical foldable side wall consisting of sections 40, 42 and 44 which extends from the panel 28 at one end, and is secured at the other end by adhesive to the panel 28 by means of a tab 54 extending outwardly from the panel 28 adjacent its bottom edge.

As it is shown most clearly in FIG. 2, the panel 28 is bent along a fold line 52 to form a horizontal support panel 46 which is shaped and dimensioned so as to fit snugly into the outlines formed by the side wall structure to support the carrier in an erect position when resting on a horizontal surface. The horizontal panel 46 has two relatively large holes 48 and 50 shaped and sized to receive and hold beverage cups, such as the cup 62 which is shown in FIG. 1 fitted into the opening 48.

Typically, the beverage cups are tapered so that they are slightly smaller at the bottom than at the top, and the holes 48 and 50 are dimensioned so as to hold the cup 62 with its upper rim 64 somewhere above the horizontal panel 46, but below the upper edge 57 of the tray 32.

The tray 30 on the other side of the central support panel 22 has a construction which is the mirror image of that shown for the tray 32. Thus, it has a side wall formed of sections 41, 43 and 45, and a horizontal support panel 47 with holes 49 and 51 for receiving beverages. Another tab 54 is used to secure the side wall to the panel 26 with adhesive or the like.

Figure 3:
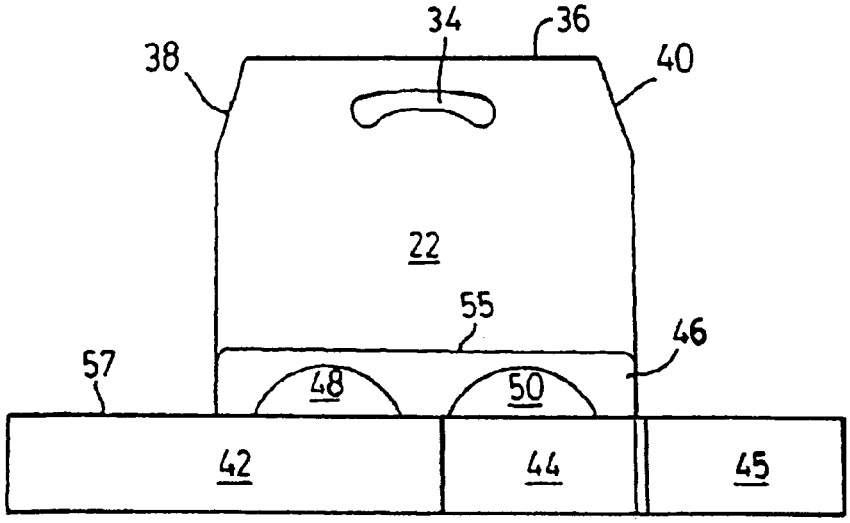
FIG. 3 is a front elevation view of the base portion of the carrier of FIG. 1 folded flat.

FIG. 3 shows the food carrier base of FIG. 1 when folded flat. Both of the side wall structures fold flat, each against its own side, and the horizontal panels 46 and 47 fold upwardly to lie flat against the central support panel 22.

Figure 4:
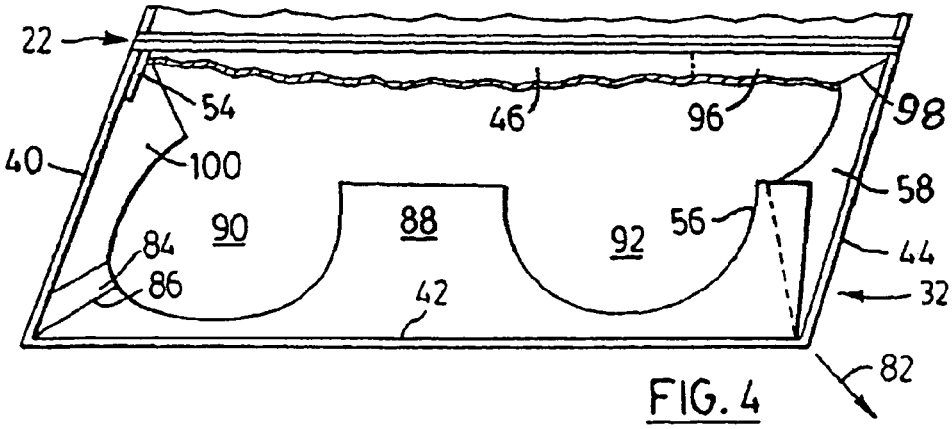
FIG. 4 is a top. plan view of a tray of the carrier base shown in FIG. 3, with the tray shown partially unfolded.

When it is desired to unfold the carrier base, the food server merely inserts his or her fingers into the corners of the folded side walls and pulls in the direction indicated by the arrow 82 in FIG. 4, and on the corresponding point in the other tray (not shown in FIG. 4) to unfold the side walls and form the trays 30 and 32.

Figure 5:
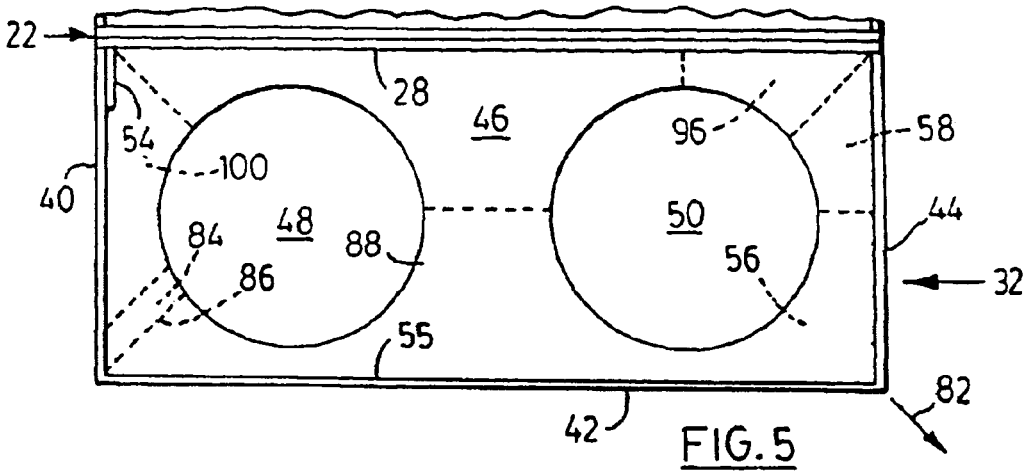
FIG. 5 is a top plan view like that of FIG. 4 with the tray fully unfolded.
Figure 14:
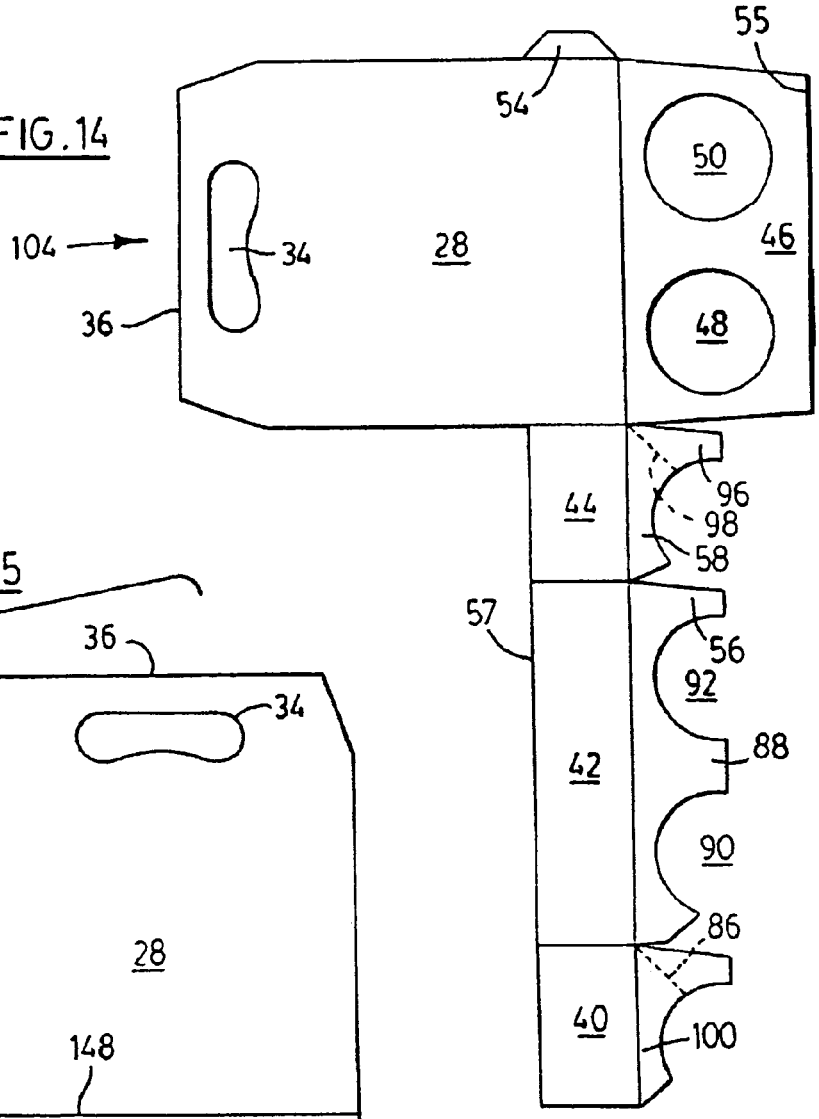
FIG. 14 is a top plan view of the cut form for one half of the carrier base shown in FIG. 1.

Referring now to FIGS. 2, 4, and 5, as well as FIG. 14, extensions 58, projections 56 and 58, 88 and 100 extend inwardly from the bottom edges 53 of the side walls to form a platform upon which the horizontal support panel 46 rests in order to support the relatively heavy weight of multiple large cups filled with beverages.

As it is shown in FIG. 4, the projections are shaped. with circular cut-out areas 90 and 92 so as to align with the edges of the holes 48 and 50 when the tray is unfolded.

The projection from the long lateral side 42 has a fold line 86 at one end and a tab 84 which is adhesively attached to the projection 100 extending from the bottom edge of the panel 40.

The projections 56 and 58 are not secured to one another and the projection 56 slides over the top of the projection 58 during unfolding.

The projection 58 from the side wall section 44 has a fold line at 98 and a tab 96 extending underneath the horizontal support panel 46. Preferably, the tab 96 is adhesively secured to the panel 46 so as to provide a means for automatically pulling the panel 46 downwardly into the space between the side walls 40, 42 and 44 as the tray is unfolded.

FIG. 5 shows the tray 32 when it is fully unfolded. The cut outs 90 and 92 align correctly with the holes 48 and 50, and the projections around the periphery provide ample support for the horizontal panel 46.

Referring now to FIG. 2, the outermost edge 55 of each panel 46 and 47 is positioned so that it preferably slightly frictionally engages the side wall 42 or 43 so as to hold it in place once it is fully rotated to its horizontal position. When the trays 30 and 32 are opened in the manner described above, the horizontal support panels 46 and 47 may not be unfolded all the way to the bottom of their respective trays. Instead, the panel is only partially depressed, to the position of panel 47 shown in FIG. 2. This is not an impediment to fast filling of the carrier, and actually may assist in locating a beverage cup such as the one shown at 66 correctly through the opening 51 in the panel 47 and the bottom of the tray. Then, when the carrier is lifted up, the weight of the full drink cups will pull the panels 46 and 47 downwardly and seat them correctly, without any further effort by the food server.

Thus, a single unfolding motion by the food server is all that is necessary to set up the food tray for loading. The horizontal panels 46 and 47, even when they are in the angular position shown in FIG. 2, hold the side walls to their desired shape so as to hold the entire carrier erect when it is resting on a horizontal surface such as the surface 60 shown in FIG. 2.

FIG. 14 shows. the fiberboard form 104 used to form one half of the carrier base. An identical form is provided to form the other half of the base, and the two vertical panels are adhered together with adhesive. The other panel portions are secured together, and the assembled unit is folded flat for shipment to the customer.

FIG. 6 shows the auxiliary tray 70 folded flat along fold lines 102. It is a very simple matter to grasp the end panels 72 and pull them apart to erect the auxiliary panel when it is desired to use an auxiliary panel. Of course, it should be understood that the auxiliary tray 70 also can be used by itself to carry solid foods. Although it usually is too flexible to safely carry beverages, it can be used to carry one or possibly two beverages, but with difficulty. It is far better and safer to use the carrier base to carry beverages.

The carrier base construction makes it strong and easily able to support the heavy weight of multiple full cups of beverages, as well as solid foods piled into the auxiliary tray 70. This is particularly so because of the folding vertical side wall construction with the horizontal support panels which hold the side walls in the desired shape.

Although it is preferred that the carrier base be used for carrying beverages, there is no reason why it cannot also be used to carry solid food items, such as hot dogs and hamburgers, if they are large enough so that they will not fall through the holes in the bottoms of the trays.

Figure 12:
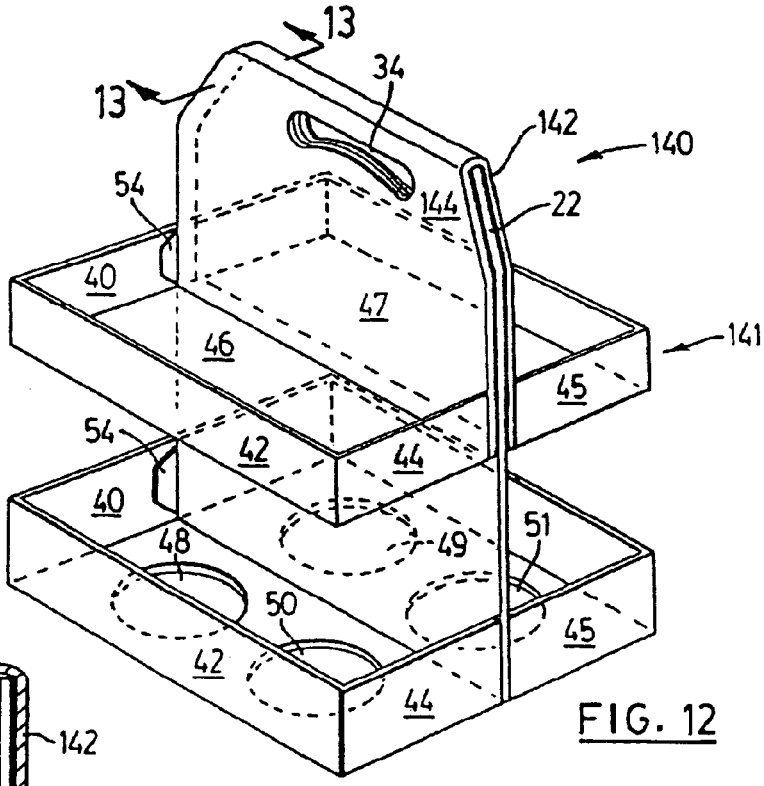
FIG. 12 is a perspective view of another embodiment of the food carrier of the present invention.
Figure 13:
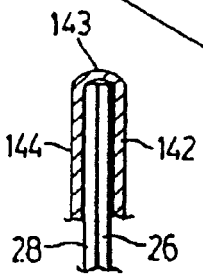
FIG. 13 is a cross-sectional, broken away view taken along line 13-13 of FIG. 12.

In fact, a version of the carrier base shown in FIG. 1 is shown in FIG. 12, without holes in the bottoms of the trays. That version is particularly good for carrying either large or small solid food items. This construction will be described in greater detail below.

Multi-Level Cup Carrier

FIG. 7 shows an alternative embodiment of the base of the carrier of the present invention. The construction of the carrier base 106 shown in FIG. 7 is largely the same as that shown in FIG. 1, and the same reference numerals are used for corresponding elements in both Figures of the drawings.

Two trays 107 and 109 are secured adjacent the bottom edge of the central support panel 22. The tray 107 has a side wall with panels 40, 42 and 44, as described above. Similarly, the tray 109 has a side wall formed of panels 41, 43 and 45, also as described above.

As it is shown in FIG. 9, the tray 107 is formed by the side wall in combination with an extension comprising panels 110, 112, 114 and 116 extending from the bottom of the panel 28 and folded as shown in FIG. 9 to form a rectangular-structure 108. The rectangular structure is adhesively secured to the panel 28 by adhesive applied to the end section 116.

An upper opening and a lower opening are provided in order to support each beverage cup. The side support provided by two separate spaced locations bearing upon the sides of the cup helps to increase the stability of the cup as it is being carried.

The folding structure 108 thus described is secured to the side walls by a pair of tabs 134 cut from the material of the panel 112, as shown in FIG. 8, so as to form the tabs. These tabs fit into notches 136 cut into the edges 42 and 43 of the side wall portions of the construction.

Figure 10:
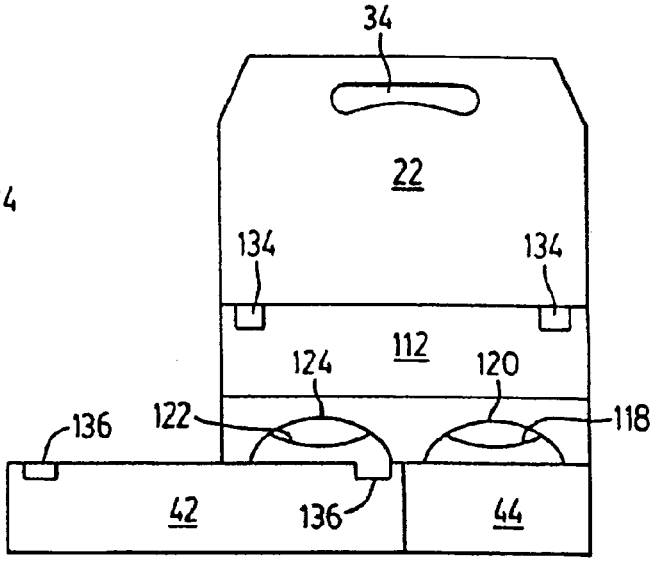
FIG. 10 is a front elevation view of the folded up carrier base which is shown unfolded in FIG. 7.

The carrier base shown in FIG. 7 is shown folded flat in FIG. 10. The structure 108 shown in FIG. 9 is folded upwardly to the position shown in FIG. 10, and the side wall portions are folded to the left, as shown.

Figure 11:
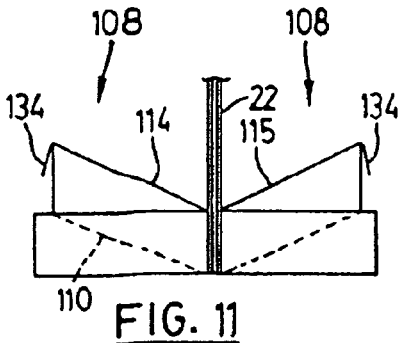
FIG. 11 is a schematic side elevation view of a portion of the base shown in FIGS. 7 and 10 in partially unfolded form.

In unfolding the carrier base, the food server merely pulls on opposite corners of the side walls, as in the FIG. 1 embodiment, and the springiness of the fiberboard causes the structures 108 to rotate partially downwardly to the position shown in FIG. 11, thus causing the side walls to hold a rectangular shape and support. the carrier base in an upright erect position to facilitate the loading of the carrier.

The extra openings 118, 122, 126 and 130 formed in the upper wall of each tray helps to stabilize the beverage containers when they are resting on a horizontal surface waiting for the carrier to be lifted upwardly.

When the carrier is lifted upwardly, the weight of the beverage cups pulls the structures 108 downwardly and causes the extending tabs 134 to be seated in the notches 136 in the side wall portions 42 and 43 so as to lock the cup holding portions 108 to the side walls to form a strong and sturdy carrier.

Alternatively, instead of the tabs 134 and notches 136, folding projections such as projections 56, 58, 80, 88 and 100 shown in FIGS. 2-5 can be used as shown in the embodiment of FIG. 1 to support the structures 108 from the bottom.

Although it is not shown in FIG. 7, it should be understood that an auxiliary tray 70, such as that shown in FIGS. 1 and 6, also can be used with the carrier base shown in FIG. 7, in the manner described above with respect to the FIG. 1 structure.

Figure 15:
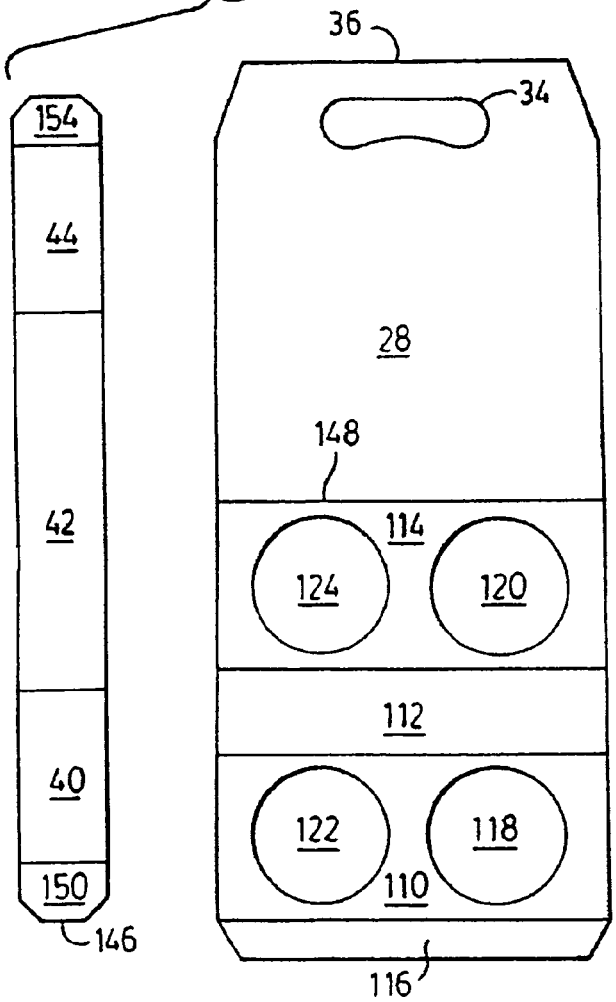
FIG. 15 is a top plan view of the cut form for one half of the carrier base shown in FIG. 12.

FIG. 15 shows the unfolded parts used to form the carrier base shown in FIG. 7. Again, the parts necessary to make only one half of the carrier base are shown, and identical parts would be used to form the other half.

The side wall portion is formed by a strip 146 which is separate from the remainder of the structure, although it could be formed as an integral extension of that structure in the manner of the embodiment. shown in FIG. 14, if desired.

The strip 146 has end portions 150 and 154 which are secured to the panel 28 adjacent its bottom. edge at the fold line 148.

Piggyback Carrier

FIG. 12 is a perspective view of another food carrier 140 of the present invention. This carrier consists of a base portion which is the same as the base portion shown in either FIG. 1 or FIG. 7, together with an auxiliary tray 141 which is almost identical in construction to the base portion of the unit shown in FIG. 1, except that there are no cup-receiving holes in the horizontal support panels 46 and 47.

Additionally, the two halves of the auxiliary carrier 141 are .formed from a single, blank or two separate parts are secured together at the top edges, so that two panels 142 and 144. are draped over the top edge of the central support panel 22. The panels 142 and 144 have holes 34 positioned to be aligned with the hole 34 in the base unit so that a unitary hand-hole 34 is formed for the combined carrier.

The two panels 142 and 144 are not secured together at the top edges 143 so that the central support panel 22 of the base unit can fit readily into the opening between the panels 142 and 144.

Thus, the auxiliary carrier 141 rides "piggyback" on the base unit.

The auxiliary carrier 141 has separate utility. When a customer orders only solid foods, or whenever the lack of beverage-receiving holes is not a detriment, the carrier 141 can be used alone. Thus, improved carrying of solid foods as well as liquids is provided. Alternatively, the auxiliary carrier 141 can have beverage-cup receiving holes so as to provide extra beverage carrying capacity.

The height of the auxiliary unit 141 should be selected so that it allows ample room for the-cups held in the cup receptacle openings in the base unit to extend a reasonable distance above the bottom of the base unit.

The materials of which the carrier of the present invention can be made need not be expensive. Ordinary, medium weight fiberboard is believed to be sufficient for most purposes. If waterproofing is necessary, a waterproof coating can be applied.

It is within the realm of the invention also to make the carriers out of flexible plastic materials.

If desired, the carriers can be made of plastic materials that are easily washable so that, the carriers can be reused.

The invention, in its various embodiments, well satisfies the objectives set forth above. The carrier is easy and quick to unfold, stands upright on its own to allow the service worker maximum utilization of his or her hands to load food into the carrier, and provides a solid, strong, safe carrying means for both liquid and solid foods. Moreover, the invention provides a relatively large amount of exterior advertising space, and can be manufactured at a moderate cost.

It should be understood that when the term "food" is used in the claims of this patent application, unless otherwise stated, the term includes all forms of food including liquid, solid, granular, and other forms.

The above description of the invention is intended to be illustrative and not limiting. Various changes or modifications in the embodiments described may occur to those skilled in the art. These can be made without departing from the spirit or scope of the invention.

What is claimed is:

1. A carrier, said carrier comprising a pair of central support panels, each having an upper edge, a pair of foldable side-wall structures, each of said side-wall structures being secured to one of said support panels and extending outwardly from said support panel when said side-wall structure is unfolded, each of said side-wall structures having an upper edge spaced downwardly from said upper edge of said one support panel by a substantial distance, each of said side-wall structures forming, together with the support panel to which it is secured, the walls of a receptacle, a pair of automatically-opening bottom structures, one for each of said side-wall structures, each of said bottom structures being folded flat when said carrier is folded, but unfolding automatically and forming a bottom structure for each of said receptacles when said carrier is unfolded, and a pair of auxiliary vertical support panels, and a pair of auxiliary receptacles, each secured to one of said auxiliary panels, said auxiliary vertical support panels having upper edges and being joined together adjacent said upper edges to form a fold, said auxiliary panels extending downwardly on opposite sides of said central support panels with said auxiliary receptacles being supported above the first-named receptacles by said fold resting on said upper edges of said central support panels.

2. A carrier as in claim 1 in which each of said auxiliary receptacles has a side-wall structure and a bottom-wall structure, and each of said bottom wall structures of said auxiliary receptacles being imperforate.

3. A carrier as in claim 1 in which each of said panels has a hand-hole adjacent its upper edge, the hand-holes in said auxiliary panels being located so as to align with the hand in said central support panels when said auxiliary and said central support panels are assembled together.

4. A method of distributing food comprising:

(a) providing a first carrier with a first pair of central support panels each with an upper edge and a lower edge and a first handle structure near said-upper edge, and a first pair of receptacles extending outwardly from each of said first central support panels adjacent said lower edge thereof, (b) providing a second carrier with a second pair of central support panels, each having a height substantially less than the height of said first central panels, each having an upper and a lower edge and a second pair of receptacles, each receptacle extending from adjacent said lower edge of one of said second central support panels, and a second handle structure adjacent said upper edge of each of said second central support panels and being positioned to align said first and second handle structures with one another, said second central support panels being joined at said upper edges to form a fold to rest upon said upper edges of said first central support panels to support said second carrier on said first carrier with said first and second handle structures grippable by one hand to carry both carriers simultaneously, (c) and selecting, to use in carrying a load, either said first carrier or said second carrier or a combination of said second carrier with said first carrier with said fold resting on said upper edges of said first central support panels, depending upon the nature of the load to be carried.

5. A carrier, said carrier comprising a pair of central support panels, each having an upper edge, a pair of foldable side-wall structures, each of said side-wall structures being secured to one of said support panels and extending outwardly from said support panel when said side-wall structure is unfolded, each of said sidewall structures having an upper edge spaced downwardly from said upper edge of said one support panel by a substantial distance, each of said side-wall structures forming, together with the support panel to which it is secured, the walls of a receptacle, a pair of automatically-opening bottom structures, one for each of said side-wall structures, each of said bottom structures being folded flat when said carrier is folded, but unfolding automatically and forming a bottom structure for each of said receptacles when said carrier is unfolded, and in which each of said bottom structures includes four flaps, each secured along a fold line to the bottom edge of one of said sidewall panels and the support panel to which the side panels are secured, in which each of said side-wall structures includes three side-wall panels secured to one another in series along fold lines, the series being connected at its ends to one of said support panels along fold lines, said flaps being secured to one another in a pattern so that said flaps are folded upwardly into the space between said side-wall panels and the support panel to which said side-wall panels are secured when said carrier is folded up, and pull upon one another when said carrier is unfolded to automatically form a bottom structure for each of said receptacles.

6. A carrier as in claim 5 in which each of said bottom structures includes four flaps, each secured along a fold line to the bottom edge of one of the side-wall panels and the support panel to which said side panels are secured, in which each of said side-wall structures includes three side-wall panels secured to one another in series along fold lines, the series being connected at its ends to one of said support panels along fold lines, and in which said flaps include, in each of said sidewall structures, a selected one of said flaps which is shaped and sized to engage one of said side-walls and hold said receptacle open to receive objects therein when said carrier is at least partially open.

7. A carrier as in claim 5 in which each of said side-wall structures includes three side-wall panels secured to one another in series along fold lines, the series being connected at its ends to one of said support panels along fold lines, in which each of said support panels has a top edge, an opposed bottom edge, and two opposed side edges, said ends of said series of panels being secured to one of said support panels adjacent said opposed side edges, said sidewall panels being foldable solely along said fold lines to fold said side-wall structures flat against said support panels, and to unfold them.

8. A carrier as in claim 5 in which one of said flaps in each of said bottom structures extends substantially all the way across the top of said bottom structure to engage the one of said side-walls of said bottom structure which is opposite to the wall to which said one flap is secured.

9. A carrier as in claim 5 in which said support panels are secured together, and including a handhold structure in said support panels.

10. A carrier as in claim 9 including a third receptacle having side-walls and a bottom wall with a slot in it, and said support panels extending upwardly through said slot with said hand-hold structure exposed to be gripped.

11. A carrier as in claim 5 in which each of two opposed side flaps of each bottom structure has a tab extending from said flap and delineated from the remainder of said flap by a diagonal fold line, and each of said tabs is secured to one of said four flaps adjacent to said tab, with said tabs being located on opposite corners of said bottom structures.

12. A foldable carrier comprising a pair of upwardly-extending central support panels, each of said pairs having an upper edge and a lower portion, a pair of foldable receptacles, each secured to and extending outwardly from said lower portion of one of said support panels when said carrier is unfolded, each of said receptacles having an upper edge substantially below said upper edge of the central support panel from which it extends, each of said side-wall structures comprising three vertical side-walls hinged together along vertical lines, each of said bottom structures being comprised of four flanges, each extending from and being hinged to the lower edge of one of said side-walls and to the lower edge of one of said central support panels, in each of said bottom structures at least two of said flanges, at opposite corners of the bottom of said receptacle, which are secured to an adjacent one of the other of said flanges and being foldable diagonally to cause said flanges to fold inwardly into said receptacle when said side-walls are folded, and to unfold to form a bottom structure when unfolded, one of said flanges in each of said bottom structures extending completely across said bottom structure between one of said support panels and the opposite one of said vertical side-walls.

13. A carrier as in claim 12 in which said one flange is sized and shaped to engage with one of said sidewalls so as to hold said receptacle open when said carrier is partially unfolded.

* * * * *